US005474171A

United States Patent [19]

Niesen et al.

[11] Patent Number: 5,474,171

[45] Date of Patent: Dec. 12, 1995

[54] DISPLAY SHIPPER

[75] Inventors: Scott M. Niesen; Joseph C. Petersen, Jr.; Robert A. Seaton, all of Madison; John F. Ausman, Eau Claire, all of Wis.

[73] Assignee: Fiskars Inc., Wausau, Wis.

[21] Appl. No.: 168,480

[22] Filed: Dec. 16, 1993

[51] Int. Cl.[6] ..... B65D 5/50

[52] U.S. Cl. ..... 206/45.19; 206/372; 206/485; 229/172; 229/178

[58] Field of Search ..... 206/45.19, 349, 206/372, 373, 485; 229/172, 178, 9, 19, 125.37, 125.38

[56] References Cited

U.S. PATENT DOCUMENTS

| | | | |
|---|---|---|---|
| 380,684 | 4/1888 | Surles | 229/125.38 X |
| 684,475 | 12/1900 | Graves . | |
| 2,289,619 | 7/1942 | Anderson, Jr. . | |
| 2,894,672 | 7/1959 | Bamburg | 229/178 X |
| 3,009,622 | 11/1961 | Leone | 206/485 |
| 3,049,224 | 8/1962 | Fredette et al. . | |
| 3,275,215 | 9/1966 | Paige | 229/178 X |
| 3,291,366 | 12/1966 | Nemoede et al. . | |
| 3,422,951 | 1/1969 | Turner et al. | 206/8 |
| 3,765,529 | 10/1973 | Mueller . | |
| 4,497,432 | 2/1985 | Milia . | |
| 4,565,316 | 1/1986 | Jes . | |
| 4,832,199 | 5/1989 | Rigby | 206/485 |
| 4,911,356 | 3/1990 | Townsend et al. | 229/178 X |
| 5,121,838 | 6/1992 | Dickie | 206/485 X |

*Primary Examiner*—Jacob K. Ackun
*Attorney, Agent, or Firm*—Foley & Lardner

[57] ABSTRACT

A shipping and display carton which may be used for such applications as merchandising elongated items such as garden shears or garden loppers is formed without using glue, tape, staples, or the like and comprises a display tray and a slidable cover. The display shipper is configured to limit set up time at the point of purchase and provides for attractively displaying all items contained therein. In a preferred embodiment of the present invention, the display shipper comprises a tray having cut out portion configured to receive a pair of oppositely facing ramps on which the items are disposed, and a slidable cover. The tray, ramp, and cover, are each made from a blank of folding carton stock.

24 Claims, 14 Drawing Sheets

DISPLAY SHIPPER

TECHNICAL FIELD

The present invention relates to the art of shipping and display cartons such as corrugated cartons, and more particularly to display shippers designed for securely packing, shipping and displaying elongated items such as garden tools. The shipping and display carton includes a display tray for receiving the elongated items and a removable cover secured to the display tray for shipment of the items. In the most preferred embodiment, the present invention relates to a shipping and display carton including a tray having cut-out sections, a slidable cover, and a pair of oppositely facing ramps removably received within the tray and suitable to advantageously display the items at the point of purchase.

BACKGROUND OF THE INVENTION

Elongated items such as garden tools of the garden shears or lopping shears type are generally displayed at the point of purchase on various pegboard arrangements. Typically, such tools are shipped in general purpose cartons adapted to receive a number of these items. These cartons are kept in inventory until it is desired to stock the items at the point of purchase. At that time, the cartons are taken out of inventory by the store clerk who, after removing taping or other closure elements, will place the items, one by one, on display fixtures designed to hold them neatly in place for a compact and attractive display. The foregoing merchandising method is commonly referred to as pegwall merchandising. As one will readily appreciate, pegwall merchandising requires handling the shipping carton a number of times and demands a fair amount of set-up time.

The limitations of pegwall merchandising have been recognized and addressed by those involved in merchandising items of this sort. For example, garden tools of the type described may also be shipped in cartons comprising an open display box designed to receive several of these items. The display box, which is dimensioned to tightly confine several of these items, is fitted with a cover which telescopes over the open box and which, in addition to protecting the items during shipment, provides the necessary structural rigidity to permit shipment of the carton by conventional distribution methods.

Typically, once received by the store, these cartons are first placed at the point of purchase on a rack having several horizontal shelves spaced apart so as to permit the carton with its cover to be loaded onto the shelf. Since these racks are normally several feet high, this loading operation often requires the use of a ladder or stepladder. Subsequently, when it becomes necessary to display the items, the carton is moved from the shelf to an area where sufficient vertical clearance permits telescoping the cover off the display box after removal of tape, staples, or the like used to secure the cover to the display box. This other merchandising method is commonly referred to as cut-carton merchandising.

While this second merchandising method alleviates some of the problems associated with pegwall merchandising, (i.e., it reduces inventory handling operations and eliminates the need to load the items individually on the pegwall display), cut-carton merchandising suffers from other shortcomings. More particularly, and as explained in the preceding paragraph, setting up the display will require taking the carton off the shelf and removing for example the tape which secures the cover to the box, to permit removal of the cover. Since these garden tools typically comprise metal blades and hardwood or steel handles, removing the carton from the shelf is preferably done by a store clerk of sufficient physical strength. On the other hand, if the cover is removed from the display box by the stocking clerk, i.e., before placing it on the rack using a ladder or stepladder, placing the display box onto the shelf will be rendered more difficult and dangerous as the structural integrity of the carton will have been compromised by removal of the cover.

In addition to this secondary handling operation, other limitations also typically characterize prior art cut-carton merchandising methods. For example, to facilitate shipment and advantageously display the features of such elongated items, cut-carton display boxes are usually factory loaded with several items disposed on edge resting on a handle, adjacent each other. As the items are purchased, the remaining items will no longer be properly supported between the front and rear panels of the box and will, as a result, tend to slide flat onto the bottom of the display box. This undesirably affects the neatness of the display, impairs viewing of the items by the consumer, and renders its access more difficult.

The various prior art limitations identified in the foregoing thus make it desirable to provide a display shipper for garden tools or the like which can alleviate the problems associated with conventional merchandising methods, i.e., which reduces inventory handling operations and requires minimum set-up time while preserving the benefits of pegwall merchandising.

SUMMARY OF THE INVENTION

The present invention provides an improved display shipper, for items such as garden shears and garden loppers, which can be economically manufactured and assembled, which is suitable for shipping and displaying the items, which requires limited overall set-up time, and which advantageously displays the items at the point of purchase.

According to one embodiment of the present invention, a display shipper comprises a display tray and an upper cover dimensioned to overlie the display tray and permit removal of the cover by sliding motion.

According to a preferred embodiment of the present invention, the display shipper is characterized in that the display tray is provided with a pair of oppositely facing ramps removably received within the tray and configured to advantageously display the items in front of cut-out portions formed in the front and rear walls of the tray.

According to another embodiment of the present invention, the display shipper is characterized in that the display tray comprises a of plurality of hingedly connected panels having adjoining bottom flaps which are configured to inter-engage to securely form the bottom of the tray, thereby eliminating the need for taping or stapling.

Other advantages of the present invention will become apparent from the detailed description given hereinafter. It should be understood, however, that the detailed description and specific embodiments are given by way of illustration only since, from this detailed description, various changes and modifications within the spirit and scope of the invention will also become apparent to those skilled in the art.

BRIEF DESCRIPTION OF THE DRAWINGS

The preferred exemplary embodiments of the present invention will hereinafter be described in conjunction with the appended drawings, wherein like numerals denote like elements, and.

DETAILED DESCRIPTION OF THE PREFERRED EXEMPLARY EMBODIMENTS

Before proceeding to the detailed description of the most preferred embodiments of the present invention, several comments are in order with respect to the scope and applicability of the cartons of the present invention. The Figures disclose a carton for shipping and displaying elongated items such as garden shears and garden loppers. However, the configuration and size of the carton could be varied to accommodate items of other dimensions or shapes, or to be suited to receive more than the number of items illustrated in the Figures. As a result, more than two oppositely facing ramps could be received in the trays, and cut-outs of shapes other than described could be formed to accommodate those other items. Furthermore, those skilled in the art will appreciate that other techniques may be used to join the panels or close the bottom flaps of one of the preferred embodiments without departing from the scope of this invention. Accordingly, while the present invention and its preferred embodiments will hereinafter be described with particular reference to cartons for garden shears or garden loppers, the skilled artisan will note its many other applications.

With respect to the preferred material used to form the tray and ramps of the display shipper of the present invention, those components are made of wax coated, 200# test B flute oyster board, while the cover is made of 200# test B flute Kraft board. However, other types of corrugated or carton stock could be employed, including pre-printed stock, recycled materials and the like, with or without such preferred coating, or to which other types of coating could be applied. In addition, although the preferred embodiments disclose display shippers which do not require glue, tape, or staples, to be formed or sealed, those skilled in the art will readily appreciate that other ways of closing and sealing these display shippers may be employed without departing from the scope of the present invention.

Figure 1:
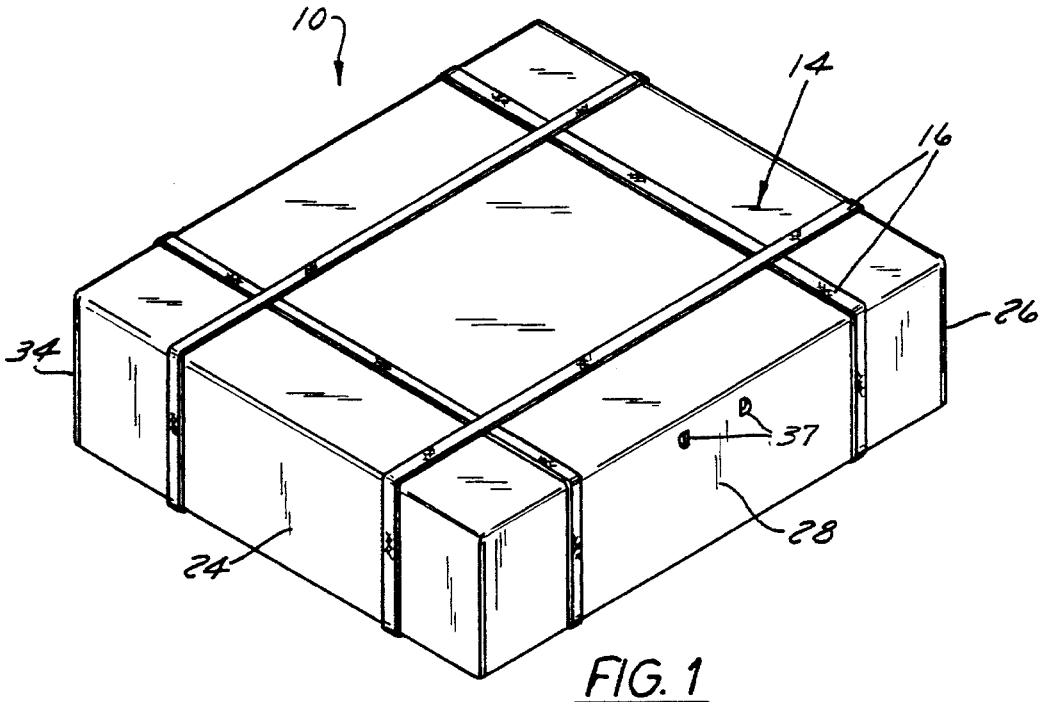
FIG. 1 is a perspective view of the display shipper in accordance with the present invention.
Figure 2:
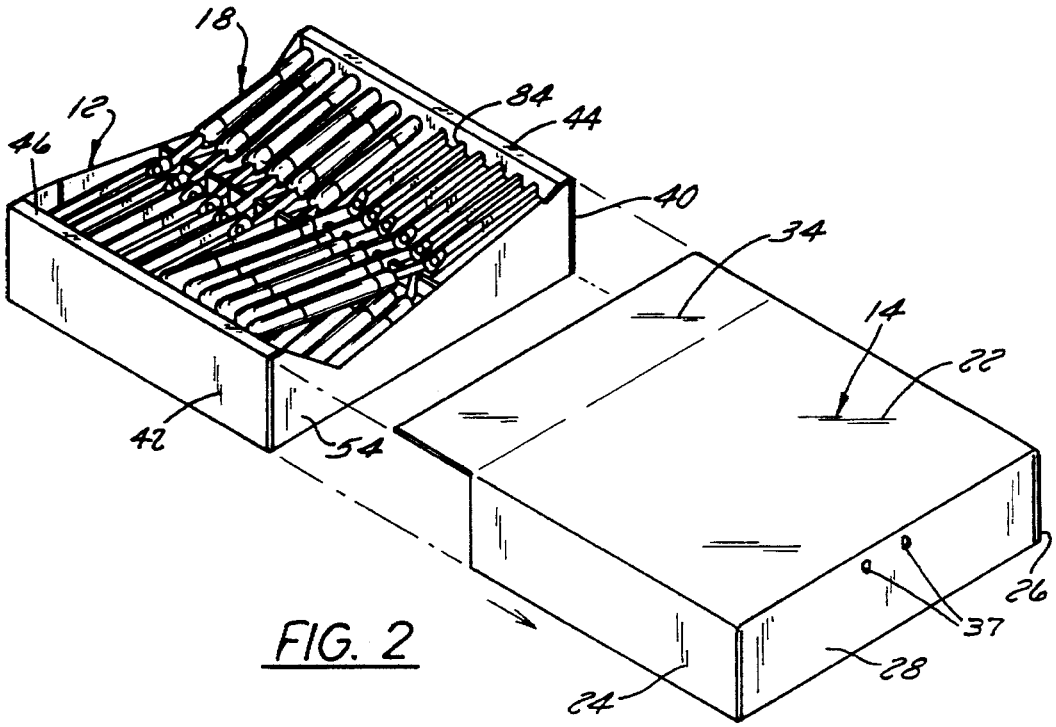
FIG. 2 is a perspective view of the display shipper in accordance with the present invention showing the cover telescoped off the display tray.

Proceeding now to a description of the first preferred embodiment of the present invention, FIGS. 1 and 2 show a display carton, generally designated as 10, in an assembled, ready for shipment condition. Carton 10 which is characterized by a width (illustrated in FIG. 1 as the major dimension), a height (the vertical dimension in FIG. 1), and a depth, comprises a display tray 12, a telescopic cover 14 overlying tray 12, and a plurality of securing elements generally designated as 16. Securing elements 16 advantageously consist of straps or bands made out of plastic or polyester, or other material suitable to maintain cover 14 over tray 12 during shipment of carton 10. Tray 12 is configured to receive a plurality of elongated items generally designated as 18. FIG. 2 illustrates cover 14 being telescoped off tray 12 in the direction of the depth of carton 10.

Figure 3:
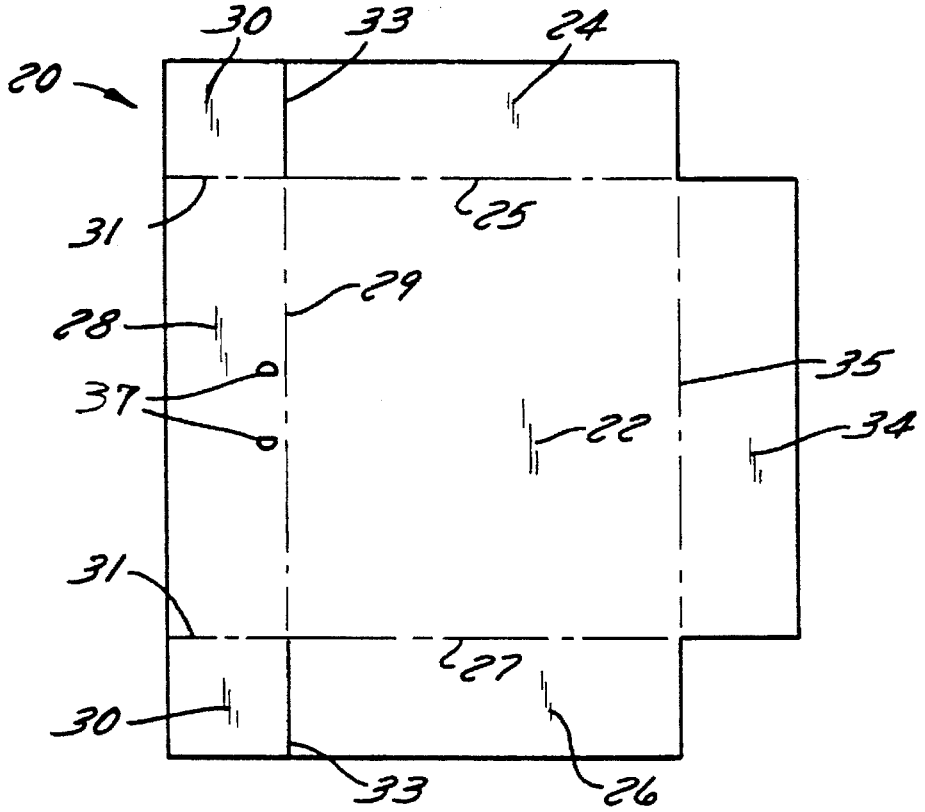
FIG. 3 is a plan view of a blank suitable for forming the cover of a display shipper in accordance with the present invention.
Figure 4:
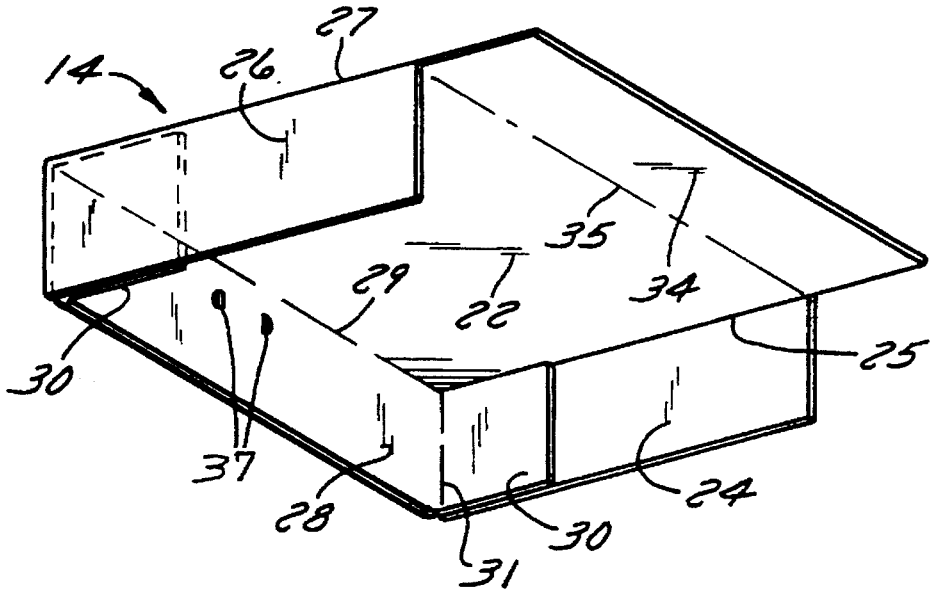
FIG. 4 is a perspective view of the cover of the display shipper in accordance with the present invention.

Referring now more particularly to FIGS. 3 and 4, cover 14 is formed from an elongated blank 20 having a plurality of panels hingedly joined by score lines which are represented in the figures of this application as phantom lines while cut lines between adjacent panels are shown as solid lines, and perforated lines are shown as broken lines. More particularly, blank 20 comprises a full-width, full-depth, top panel 22, first and second full-depth, full-height side panels 24, 26, joined by score lines 25, 27, on either side of top panel 22. Blank 20 further comprises a full-width, full-height front panel 28 joined to panel 22 along score line 29. Panel 28 is provided with a pair of guiding flaps 30 joined along score lines 31 on either end of front panel 28. Guiding flaps 30 are separated from side panels 24, 26 by cut lines 33 to permit guiding flaps 30 to be tucked under panels 24, 26 to form cover 14. Cover 14 also comprises a full-width, full-height rear panel 34 joined by a score line 35 to top panel 22. As more clearly shown in FIG. 4, after cover 14 has been formed, panel 34 remains hingedly connected to top panel 22 along score line 35. Cover 14 is also preferably provided with a pair of openings 37 in front panel 28 to facilitate removal of cover 14 off tray 12.

Figure 5:
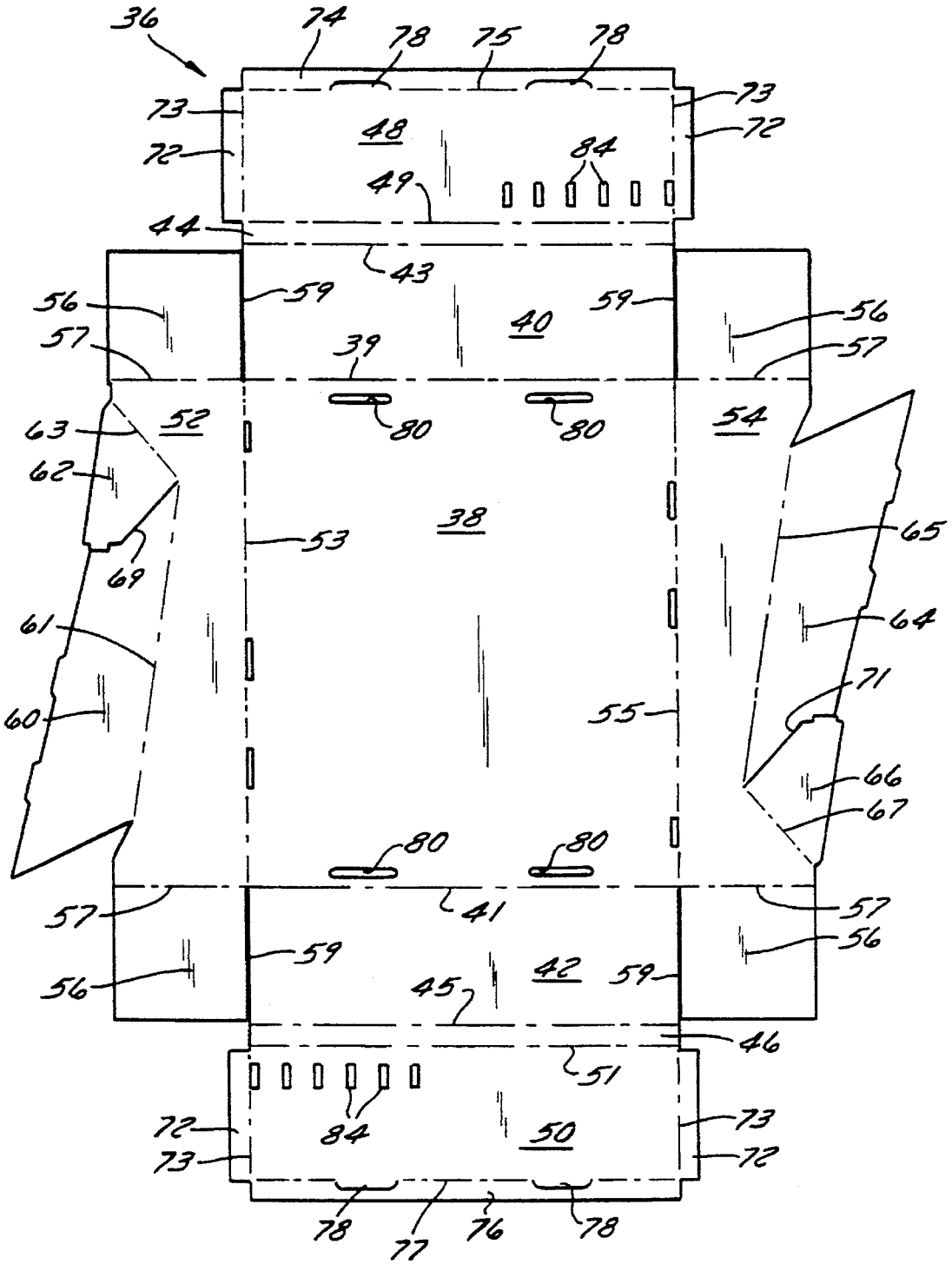
FIG. 5 is a plan view of a blank suitable for forming the display tray of a display shipper in accordance with the present invention.
Figure 7:
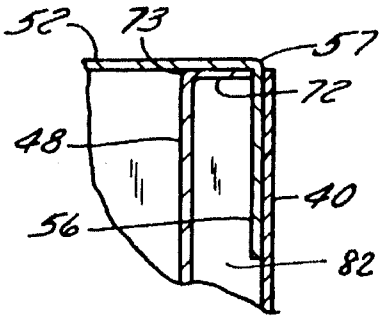
FIG. 7 is a fragmentary cross-sectional view taken along line 7—7 in FIG. 6.
Figure 6:
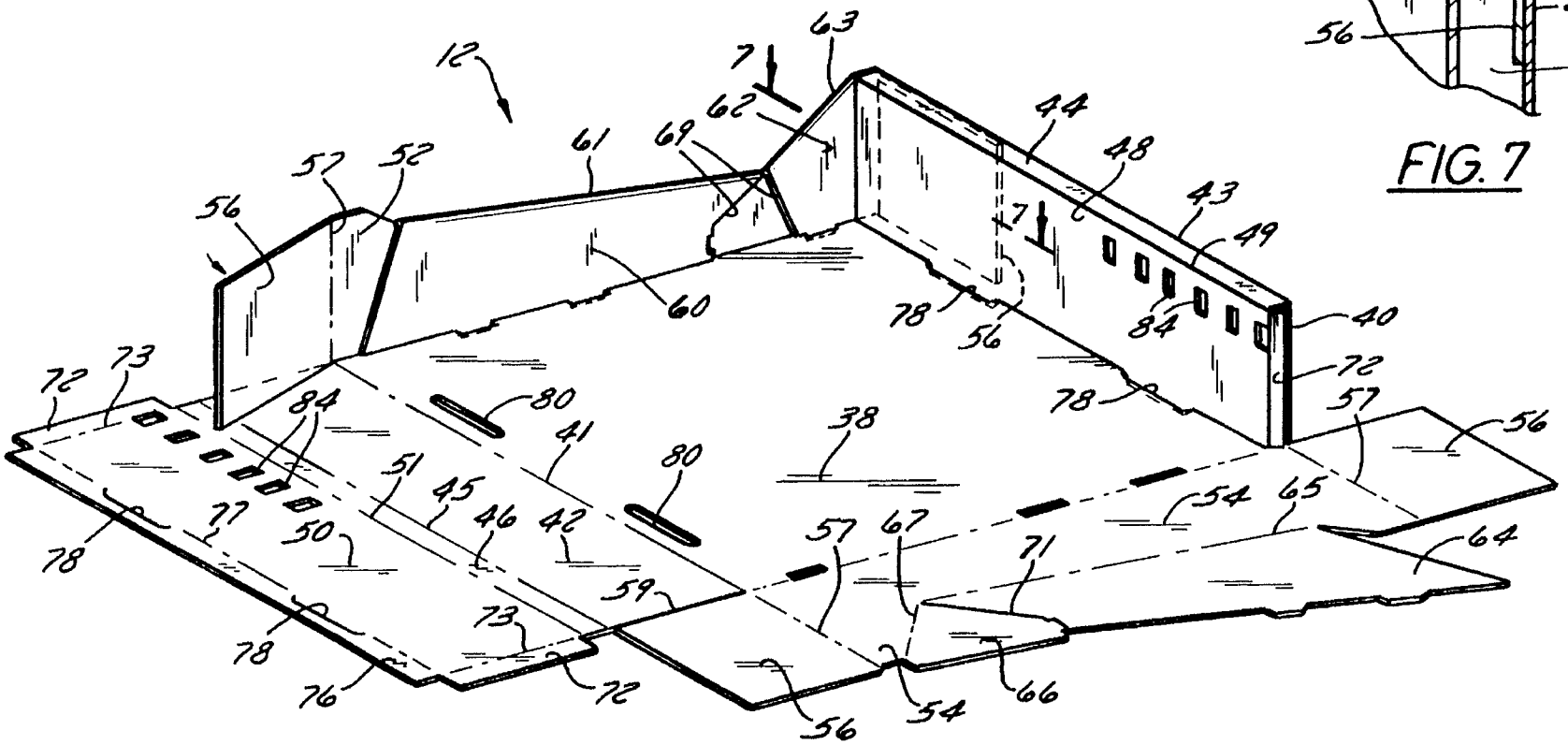
FIG. 6 is a perspective view of a partially formed display tray in accordance with the present invention.
Figure 8:
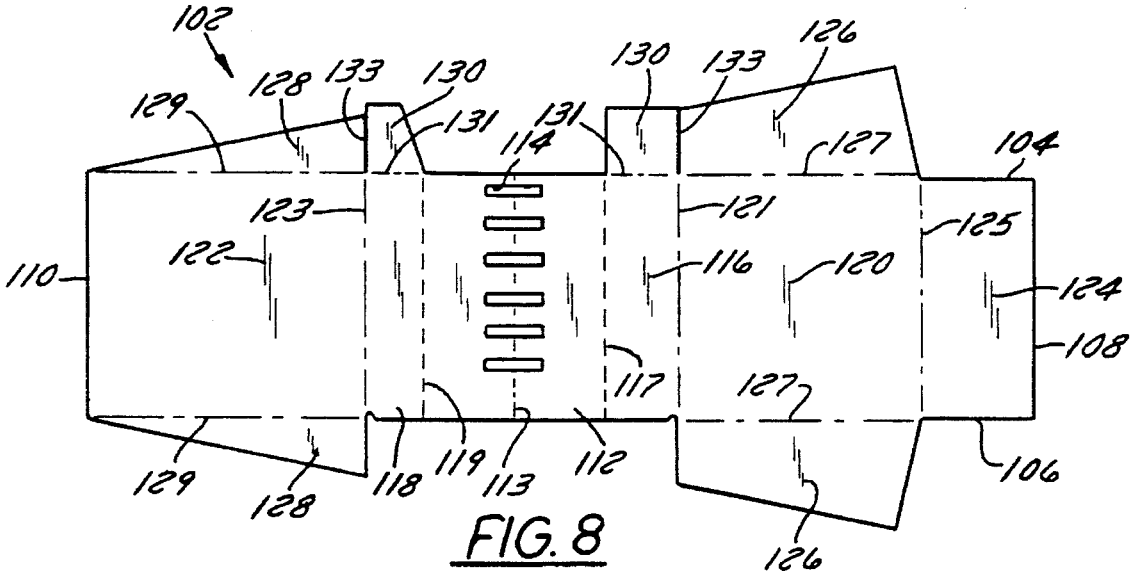
FIG. 8 is a plan view of a blank suitable for forming a ramp used with a display shipper in accordance with the present invention.

Turning now to the description of tray 12 and referring more particularly to FIGS. 5–7, a blank 36 is used to form the first embodiment of tray 12. Blank 36 includes a plurality of panels joined by score lines. In particular, blank 36 comprises a full-width, full-depth, bottom panel 38 to which are joined first and second full-depth, full-height outer panels 40, 42, respectively, along score lines 39, 41. Blank 36 also includes first and second full-depth web panels 44, 46 joined by score lines 43, 45 to first and second outer panels 40, 42, respectively, and first and second full-depth, full-height inner panels 48, 50 adjoining web panels 44, 46, respectively, by score lines 49, 51.

Blank 36 also comprises full-width, full-height front and rear wall panels 52, 54, respectively, joined to bottom panel 38 by score lines 53, 55 running along the sides of blank 36. Front and rear panels 52, 54 are provided on either end thereof with tuck flaps 56 joined to panels 52, 54 by score line 57. Tuck flaps 56 are separated from adjoining outer panels 40 and 42 by cut lines 59. The function of tuck flaps 56 will be more particularly described in connection with FIGS. 6 and 7. Each of front and rear wall panels 52, 54 is also advantageously provided with a pair of reinforcing flaps 60–62 and 64–66, respectively, joined to front and rear wall panels 52, 54, by score lines 61, 63, 65, 67, and mutually separated by cut lines 69, 71. First and second inner panels 48, 50 also include retaining flap 72 hingedly connected by a score line 73 on either end thereof. The function of retaining flap 72 will also be described in more detail in connection with the description of FIGS. 6 and 7.

Adjoining each of first and second inner panels 48, 50, at either end of blanks 36, are spacing panels 74, 76, adjoining along score lines 75, 77, first and second inner panels 48, 50, respectively. Spacing Panels 74, 76 may also include securing tabs 78 designed to engage openings 80 formed in bottom panel 38. Securing tabs 78 which are advantageously formed from scored portions of spacing panels 74, 76 extend inwardly of score lines 75, 77. The particular engagement of securing tabs 78 with openings 80 will be described more completely in connection with the forming of tray 12.

Referring now more particularly to FIGS. 5–7, the forming of tray 12 will now be particularly described. Preferably, tuck flaps 56 are folded inwardly along score lines 57 and front and rear wall panels 52, 54 are folded inwardly along score lines 53, 55, respectively. Inner panels 48, 50, are folded along score lines 49, 51, and web panels 44, 46, are folded along score lines 43, 45 thereby receiving tuck flaps 56 in the channels 82 formed when inner panels 48, 40, are formed substantially parallel outer panels 40, 42, respectively. In such configuration, web panels 44, 46, are substantially parallel to bottom panel 38, thereby permitting several open trays 12 to be stacked on top of each other by having the bottom panel 38 of an upper tray sturdily rest on the web panels 44, 46 of a lower tray 12. Inner panels 48, 50, are maintained respectively parallel to outer panels 40, 42, by inserting securing tabs 78 in corresponding slots 80 after folding spacing panels 74, 76, inwardly along score lines 75, 77 so that tabs 78 can project away from such score lines. As shown in FIG. 7, tuck flaps 56 are maintained within channels 82 by retaining flaps 72 by folding retaining flaps 72 along score line 73 preferably prior to inserting tabs 78 in slots 80.

Referring now to FIGS. 5 and 6, inner panels 48, 50, are provided with a plurality of openings 84 formed inwardly of score lines 49, 51, respectively, and extending along a line substantially parallel thereto over a predetermined distance from non-adjacent corners of display tray 12. The function of openings 84 will be described in detail in the following material.

Now that all of the physical features of blank 36 have been described, a few additional comments will assist one skilled in the art to understand the particular function of several of these features. Supporting flaps 60, 62, 64, 66, are designed to provide additional rigidity to front and rear panels 52, 54. In particular, supporting flaps 60, 62, 64, 68, are preferably shaped so that when front and rear panels 52, 54 are erected, flaps 60, 62, 64, 66, will be folded along score lines 61, 63, 65, 67, to abut against bottom panel 38.

Display carton 10 is also preferably provided with a pair of ramps generally designated as 100 which will be described in connection with FIGS. 8–12. An elongate blank 102 having two generally parallel sides 104, 106, an upper end 108, and a lower margin 110, is used to form ramp 100 as is shown in a plan view in FIG. 8. Blank 102 comprises a divider panel 112 having a center score line 113 running perpendicular to sides 104, 106. Divider panel 112 further comprises a plurality of slots 114 formed generally perpendicular to and at spaced position along center score line 113 and extending on either side thereof by a predetermined distance. Divider 112 is joined on either end thereof to intermediate panels 116, 118, preferably by perforated lines 117, 119 illustrated in short dashed lines in FIG. 8. Blank 102 is also provided with upper and lower margin panels 120, 122, respectively, hingedly connected to first and second intermediate panels 116, 118 by score lines 121, 123, and an elevation flap 124 joined to upper panel 120 along score line 125. Upper panel 120 is also provided with a pair of truncated, triangular shaped, upper margin flaps 126 joined to upper margin panel 120 by a score line 127 running along sides 104, 106. Lower margin panel 122 is provided with generally triangular shaped lower margin flaps 128 joined to lower margin panel 122 by a score line 129 along sides 104, 106. Finally, blank 102 may also be provided with a plurality of supporting flaps 130 joined to intermediate panels 116, 118 by a core line 131 along sides 104, 106, and separated from upper and lower margin flaps 126, 128, by cut lines 133.

Figure 9:
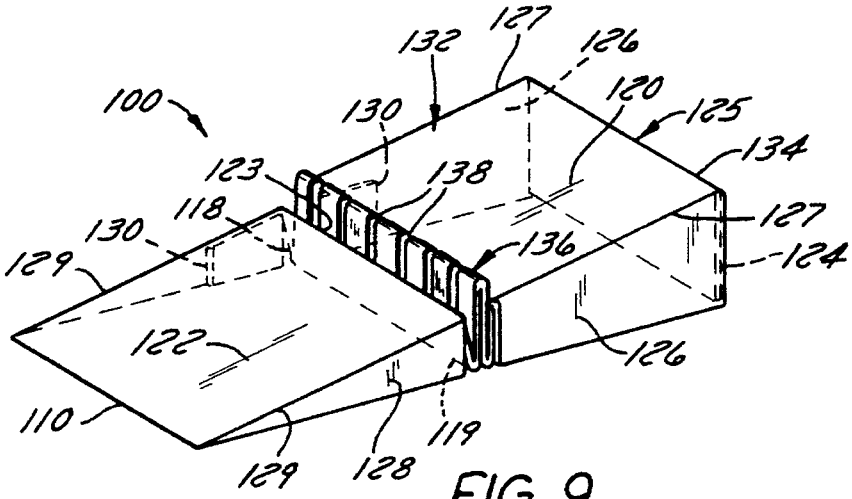
FIG. 9 is a perspective view of a ramp used with the display shipper in accordance with the present invention.

Ramp 100, as illustrated in perspective view in FIG. 9, has an upper surface 132 extending between lower margin 110, and upper margin 134, which is also designated as score line 125. Ramp 100 also comprises a divider 136 projecting from upper surface 132 by a predetermined distance. Divider 136 comprises a plurality of seats 138 at spaced intervals therealong. Now that all features of ramp 100 have been identified, the formation of ramp 100 will be described.

Holding blank 102 with upper surface 132 upwardly facing, divider panel 112 is folded downwardly along score line 113 and intermediate panels 116, 118 are folded along perforated lines 117, 119 so that the upper surface portions of intermediate panels 116, 118 are adjacent the upper surface of divider panel 112. Slots 114 cooperating with folded divider panel 112 form receiving seats 138 at spaced positions along divider 136. Supporting flaps 130 are folded along score lines 131 and upper and lower margin flaps 126, 128 are folded along score lines 127, 129, thereby overlying supporting flaps 130. Elevation flap 124 is folded along score line 125 to complete the formation of ramp 100.

Figure 10:
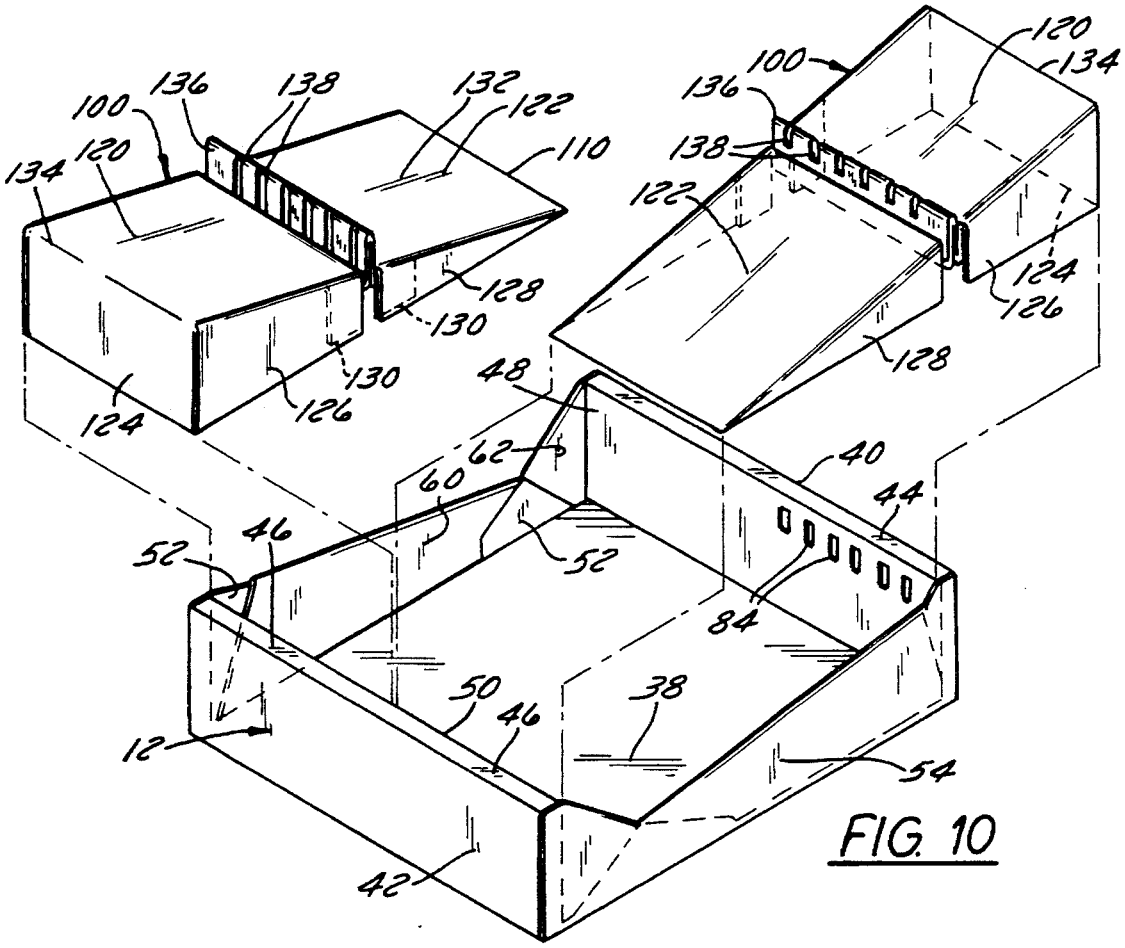
FIG. 10 is a perspective view of the display tray of the display shipper in accordance with the present invention, showing a pair of ramps being disposed oppositely facing in the tray.
Figure 11:
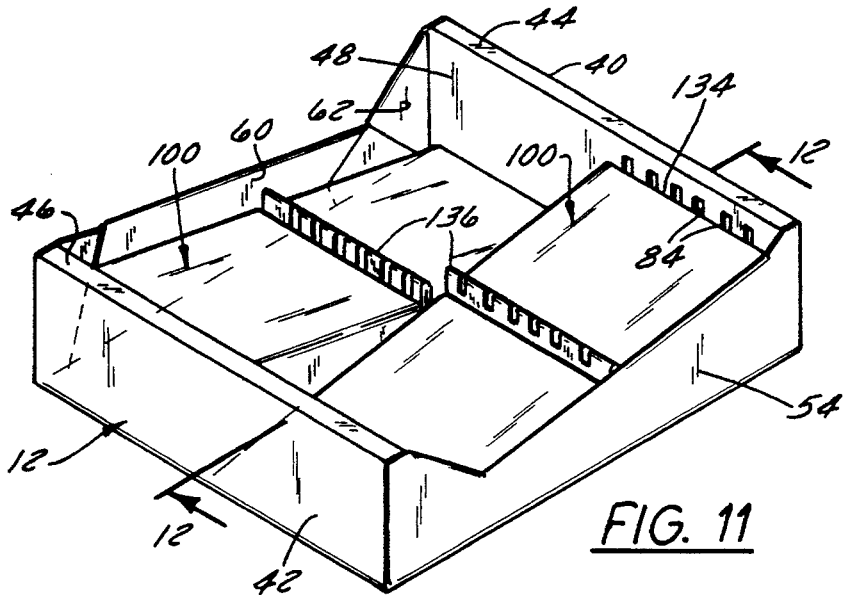
FIG. 11 is a perspective view of the display tray of the display shipper in accordance with the present invention, showing a pair of ramps received oppositely facing in the tray.
Figure 12:
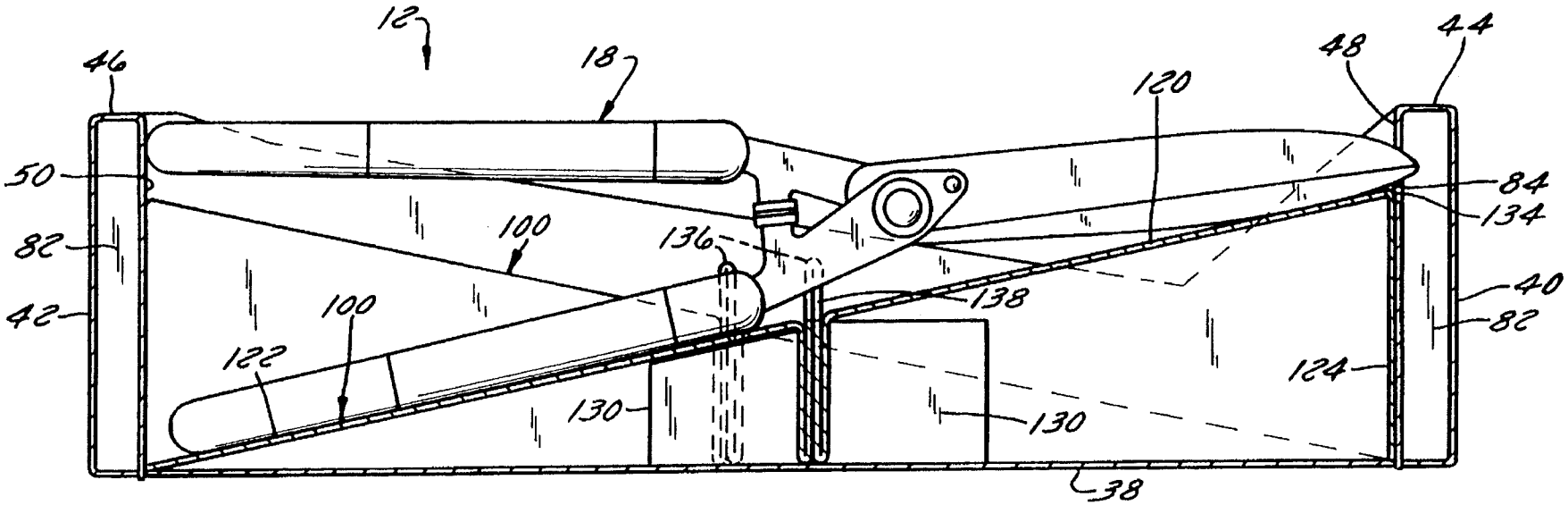
FIG. 12 is a cross-sectional view taken along line 12—12 in FIG. 11, showing an elongated garden tool disposed on a ramp with the divider engaging that item and the tip of the blades of that item received within a channel of the tray.

Turning now to FIGS. 10 and 11 more particularly, two ramps 100 are being disposed in oppositely facing configuration inside display tray 12, so that upper margin 134 is disposed proximate openings 84. As more particularly shown in FIGS. 11 and 12, when ramps 100 are disposed in display tray 12, upper margin 134 is located proximate openings 84 which are substantially in alignment with seats 138. This configuration permits the tip of an elongated item 18 passing through opening 84 to be captured in channel 82, while each seat 138 engages a portion of elongated item 18, thereby neatly maintaining such items equally separated, substantially in the same manner as that achieved with pegboard merchandising. FIGS. 11 and 12 also illustrate that ramp 100 and the configuration of front and rear walls 52, 54 cooperate to advantageously display desirable features of item 18.

Figure 13:
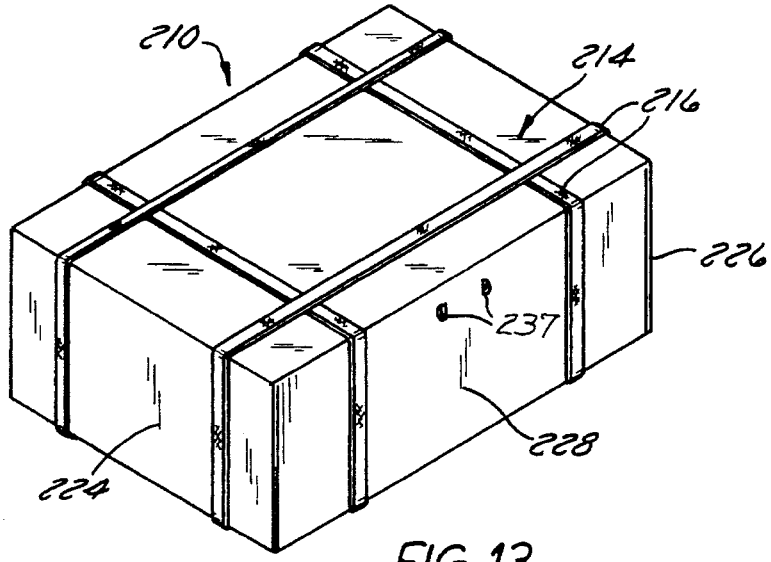
FIG. 13 is a perspective view of a second embodiment of the display shipper in accordance with the present invention.
Figure 14:
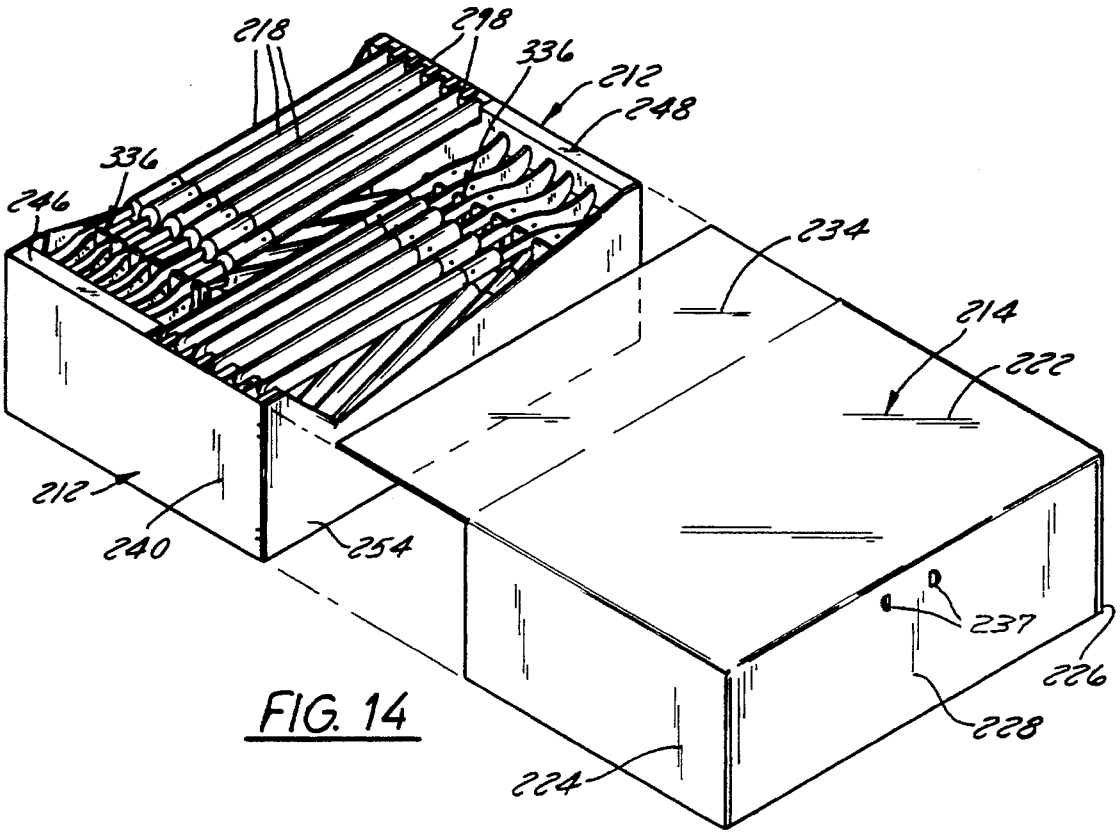
FIG. 14 is a perspective view of the display shipper in accordance with the second embodiment of the present invention showing the cover telescoped off the display tray.

Turning now to the description of a second preferred embodiment of the present invention, and more particularly to FIGS. 13 and 14, a display carton generally designated as 210 is shown having a width (the major dimension in FIG. 13), a height (the vertical dimension in FIG. 13), and a depth. Carton 210 comprises a display tray 212 and a telescoping cover 214 maintained on tray 212 by securing elements 216. Tray 212 is configured to receive a plurality of oppositely facing elongated items 218. Cover 214 which is of a configuration similar to cover 14 will not be further described as it is formed from a blank similar to blank 20 which was described with particularity in connection with the first embodiment of the present invention.

Figure 15:
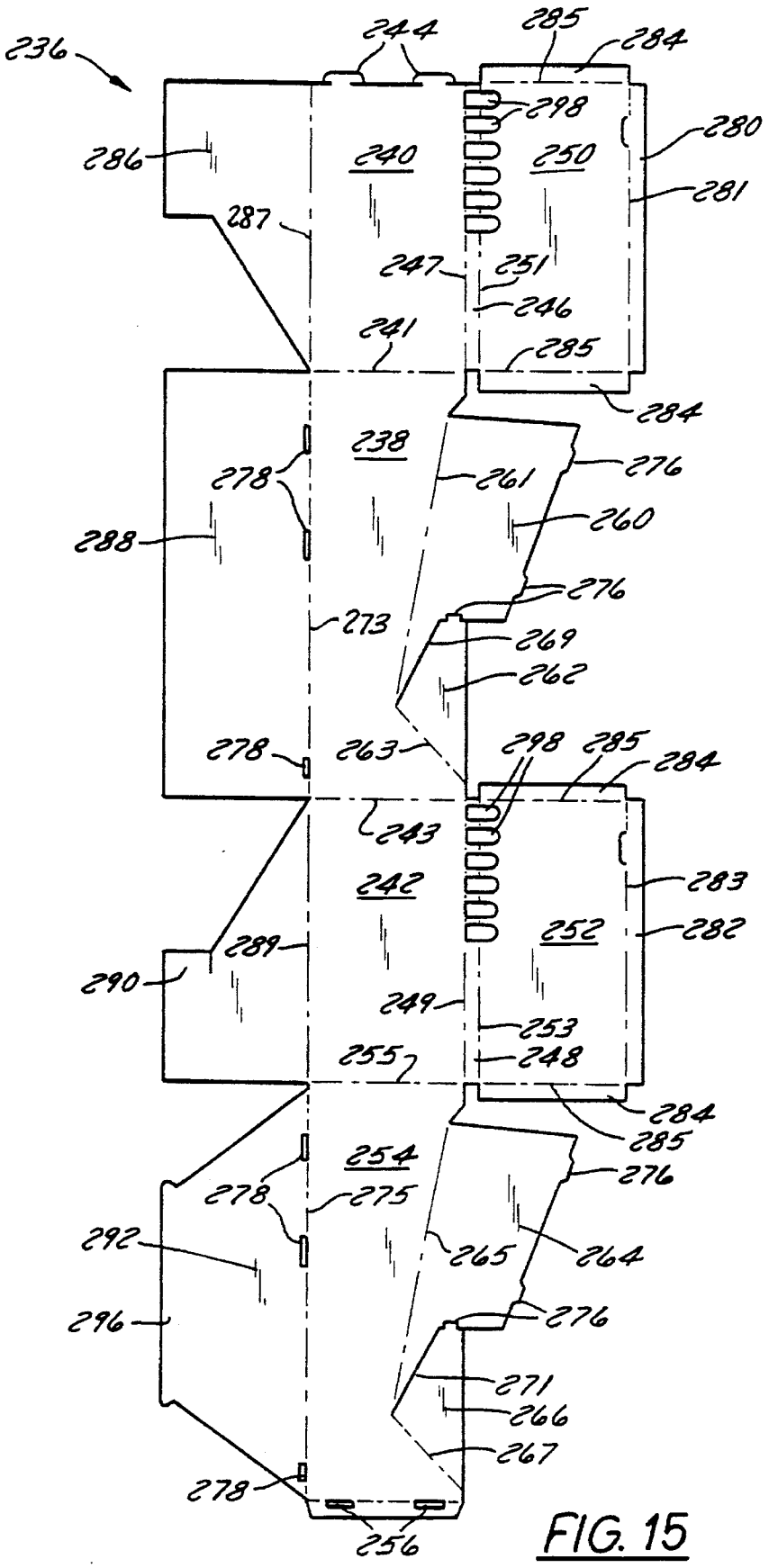
FIG. 15 is a plan view of a blank suitable for forming the cover of a display shipper in accordance with the second embodiment of the present invention as shown in FIG. 14.

Turning now to tray 212, a plan view of the blank 236 used to form tray 212 is illustrated in FIG. 15. Blank 236 comprises a plurality of panels hingedly connected by score lines so as to be foldable into a substantially rectangular configuration. In particular, blank 236 includes a first full-width, full height front wall panel 238 to which first and second full-depth, full height outer panels 240, 242 are hingedly connected along score lines 241, 243. First outer panel 240 is provided at its free end with a plurality of first closure elements 244. Blank 236 also includes first and second full-depth web panels 246, 248 joined to respective first and second outer panels 240, 242 by a score line 247, 249. First and second web panels 246, 248 are adjoined to first and second inner panels 250, 252 along score lines 251, 253.

Blank 236 is further provided with a full-width, full-height rear wall panel 254 joined to second outer panel 242 along score line 255. The free end of rear panel 254 is provided with second closure elements 256 disposed to cooperate with first closure elements 244 when panels 238, 240, 242, and 254 are folded in substantially rectangular configuration, as more clearly illustrated in FIGS. 16 and 17. Front and rear wall panels 238, 254 are also advantageously provided with a reinforcing flaps 260, 262, 264, and 266, joined to panels 238, 254 by score lines 261, 263, 265, 267, but are mutually separated by cut lines 269, 271. As explained in connection with the first embodiment of the present invention, flaps 260, 262, 264, and 266, are shaped so as to abut to respective score lines 273, 275 thereby adequately reinforcing front and rear panels 238, and 254. Preferably, the edge of reinforcing flaps 260, 262, 264, 266 is advantageously provided with at least one tab 276 to be inserted upon folding of the reinforcing flaps in corresponding openings 278.

Blank 236 is also advantageously provided with spacing panels 280, 282 joined along score lines 281, 283, to respective adjacent first and second inner panels 250, 252. The function of spacing panels 280, 282, is similar to that of panels 74, 76, described in connection with the first embodiment of the invention. Blank 236 may also include edge flaps 284 joined along score lines 285 to inner panels 250, 252, to increase overall structural rigidity.

Blank 236 also includes a plurality of openings 298 formed in first and second web panels 246, 248 inwardly of score lines 247, 249, and extending by a predetermined distance into inner panels 250, 252, through score lines 251, 253, respectively. Openings 298 are formed in non-adjacent corners of tray 212 along a line substantially parallel to score lines 251, 253, over a predetermined distance from such non-adjacent corners. Openings 298 are designed to receive at spaced intervals the extremity of a handle of item 218, as will be more completely explained below.

Figure 16:
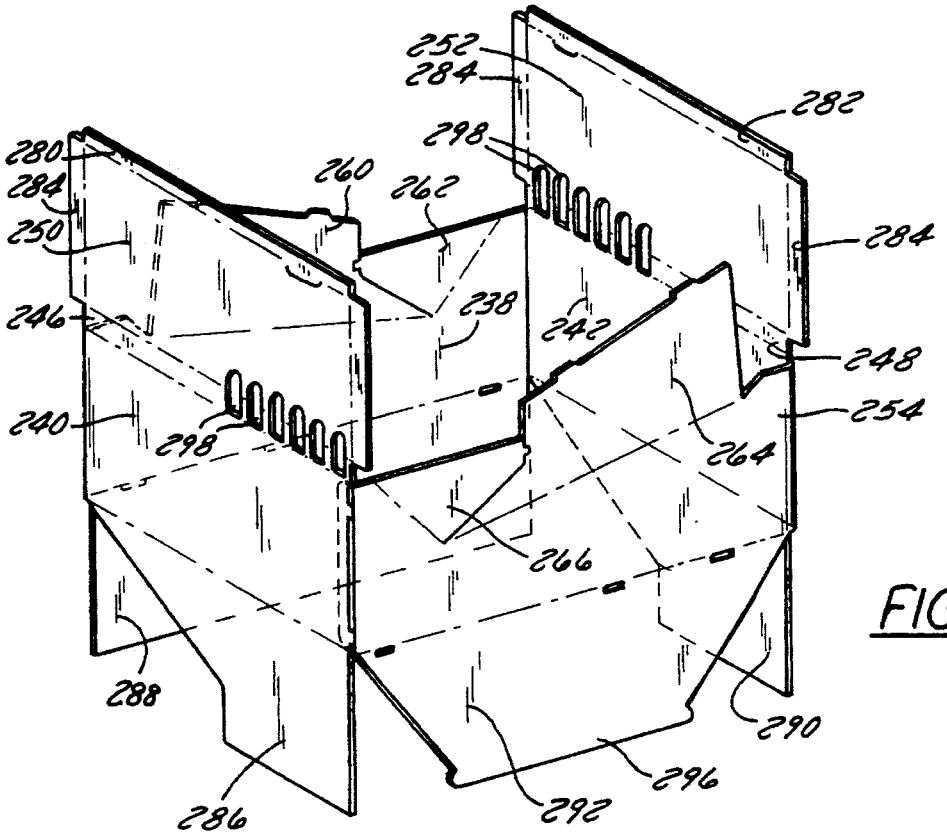
FIG. 16 is a perspective view of a partially formed display tray in accordance with the present invention.
Figure 17:
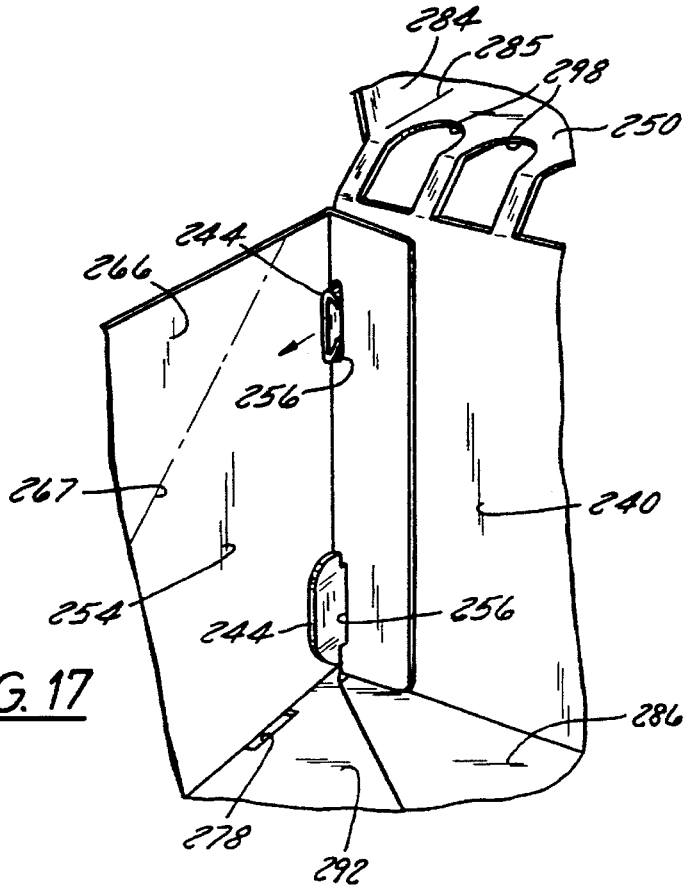
FIG. 17 is a fragmentary view of the corner of the display tray as shown in FIG. 16, showing the engaging free ends of the tray being secured by closure elements.
Figure 18:
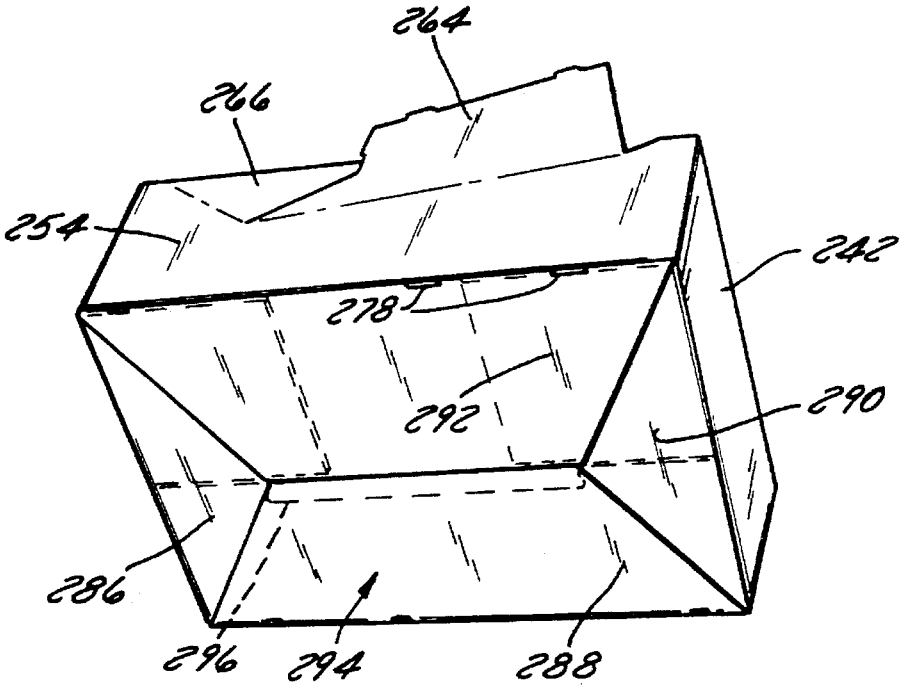
FIG. 18 is a perspective view taken from below the assembled display tray of the second embodiment of the present invention, showing the inter-engaging bottom flaps of the tray.
Figure 19:
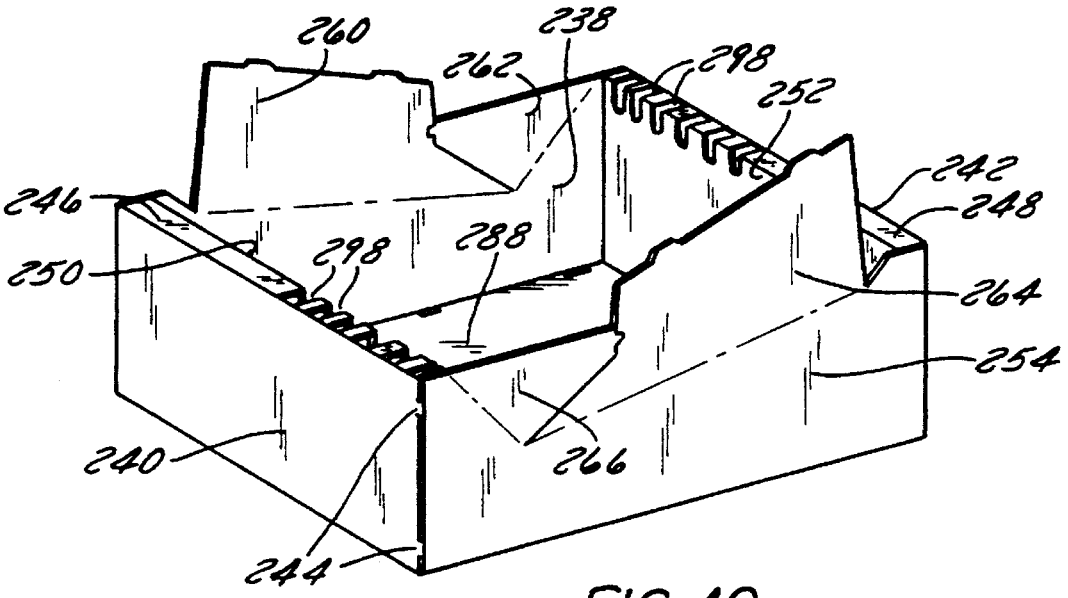
FIG. 19 is a perspective view of a partially formed display tray in accordance with the second embodiment of the present invention.
Figure 20:
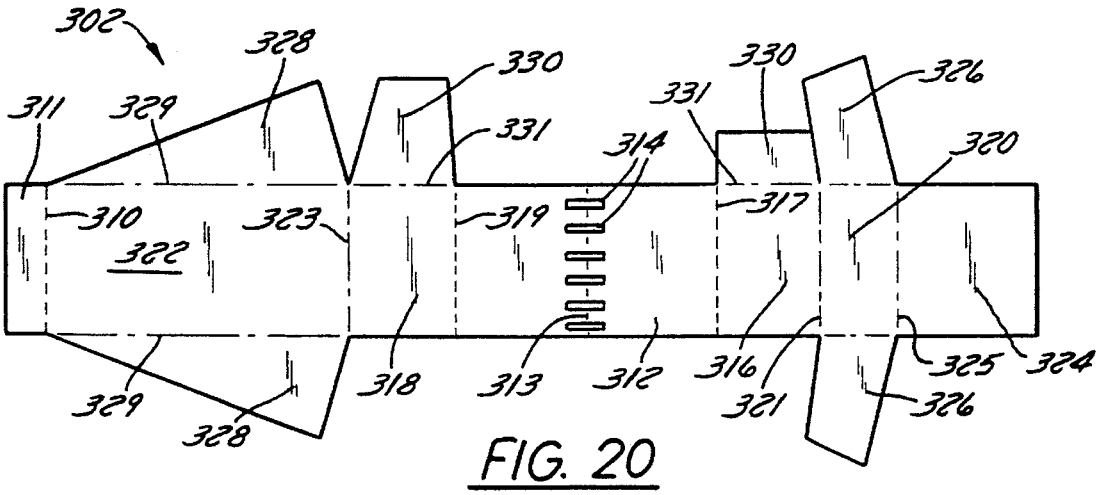
FIG. 20 is a plan view of a blank suitable for forming a ramp used with a display shipper in accordance with the second embodiment of the present invention as shown in FIG. 14.
Figure 21:
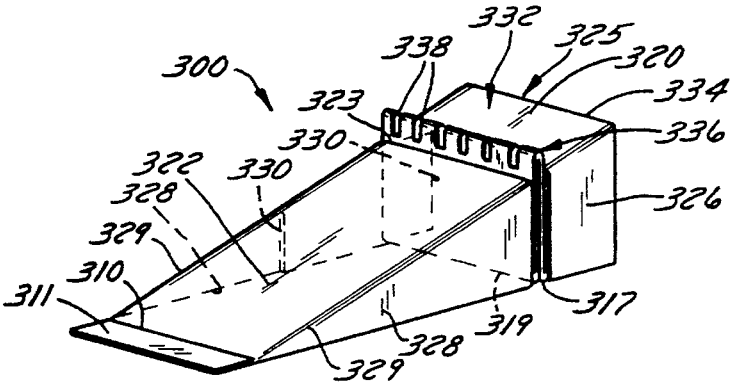
FIG. 21 is a perspective view of a ramp used with a display shipper in accordance with the second embodiment of the present invention as shown in FIG. 14.
Figure 22:
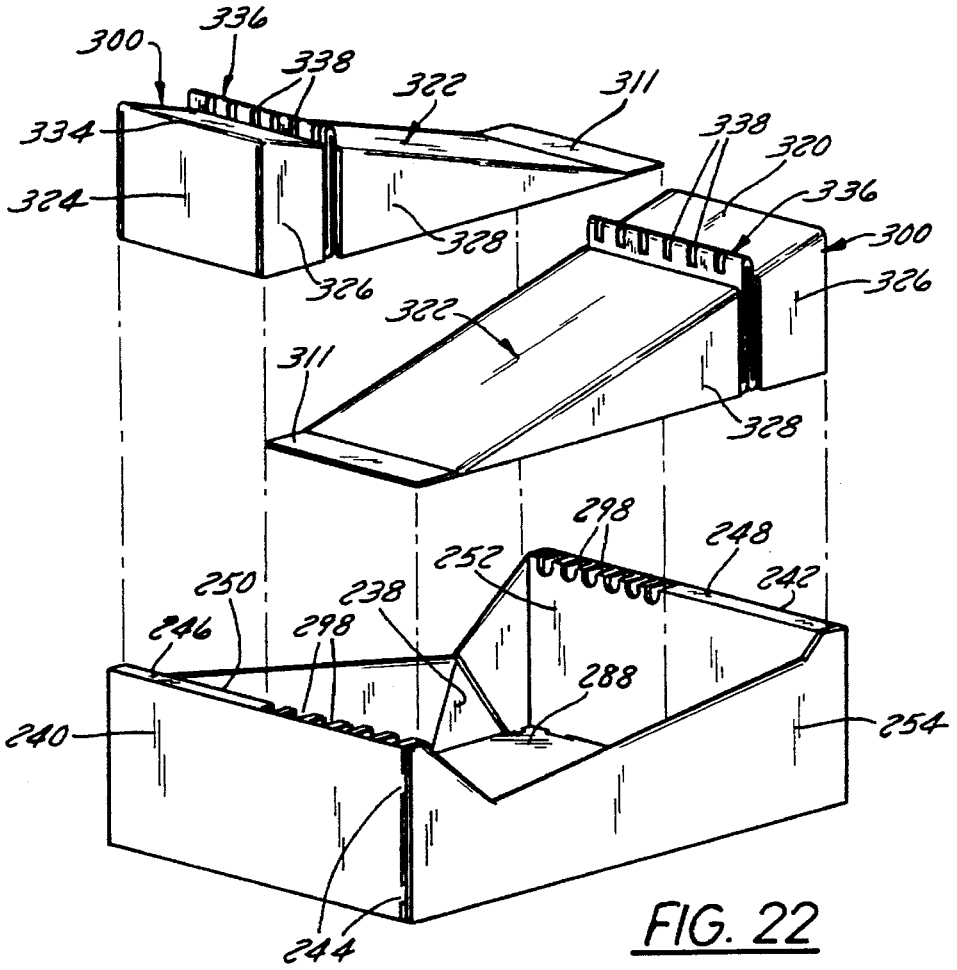
FIG. 22 is a perspective view of the display tray of a display shipper as shown in FIG. 14, showing a pair of ramps being disposed oppositely facing in the tray.

Describing another feature of the present invention and referring to FIGS. 15, 16 and 18, blank 236 is preferably provided with a plurality of inter-engaging bottom flaps 286, 288, 290, and 292 joined respectively to panels 240, 238, 242, and 254, along score lines 287, 273, 289, and 275. These bottom flaps are particularly configured so as to releasably inter-engage upon folding along these score lines following a definite folding sequence to form the bottom 294 of tray 212. This feature eliminates the need for tape, glue, or staples, to form bottom 294. More particularly, and as shown in FIGS. 15 and 16, (i) inner full-width, half-depth bottom flap 288 is folded first along score line 273; (ii) full-depth, partial side bottom flaps 286, 290, are folded next thereby overlying inner flap 288 and; (iii) full-width, half depth, outer bottom flap 292 is folded last. Outer flap 292 is provided, in the region of its free edge substantially parallel to score line 275, with a tongue a 296 which is slid over the inner surface of inner flap 288 to inter-engage bottom flaps 286, 288, 290, and 292, thereby preventing their accidental disengagement.

Referring now to FIGS. 20–24, display shipper 210 also includes a pair of oppositely facing ramps 300 removably disposed inside tray 212. As can readily be seen from a comparison of FIGS. 8–11 of the first embodiment with FIGS. 20–23 of the second embodiment, ramp 300 is substantially similar to ramp 100. Accordingly, a detailed description of ramp 300 will not be repeated at this point but to facilitate identification of the various parts of ramp 300, reference numerals having the same last two digits have been used to designate elements of similar construction and function. It should be noted, however, that the dimensions of ramp 300 and constituting panels are somewhat different from those of ramp 100 to accommodate elongated items 218 of distinct construction. As a result, the location of divider 336 intermediate upper and lower margins 334, 310 is noticeably different from that of divider 136. In addition, ramp 300 may also be provided with an end panel 311 joined to lower margin panel 322 by score line 310 to prevent widthwise movement of ramp 300 within tray 212.

Figure 23:
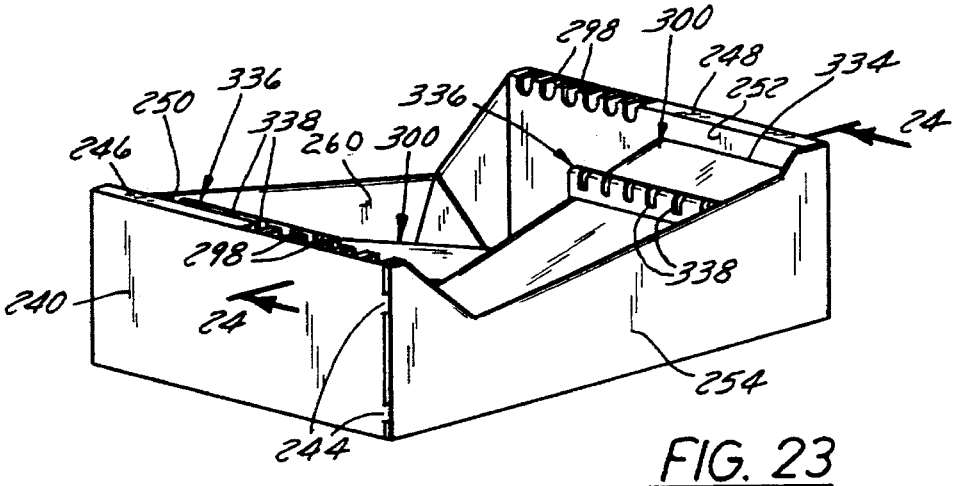
FIG. 23 is a perspective view of the display tray of the display shipper as shown in FIG. 18, showing a pair of ramps received oppositely facing in the tray.
Figure 24:
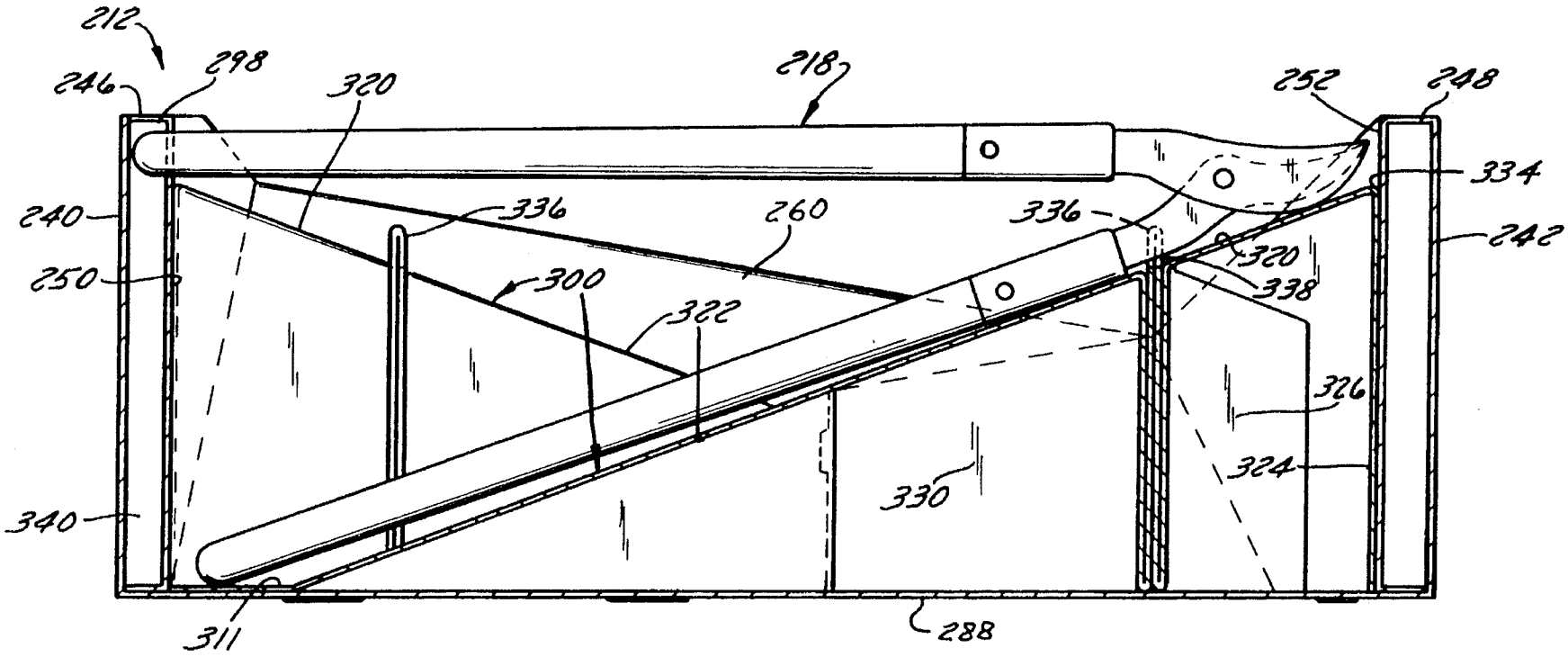
FIG. 24 is a cross-sectional view taken along line 24—24 in FIG. 23, showing an elongated garden tool disposed on a ramp with the divider engaging that item and the handle of that item received within a channel of the tray.

As more particularly shown in FIGS. 23 and 24, when ramps 300 are disposed in display tray 212, upper margin 334 is located opposite openings 298 which are substantially in alignment with seats 338. This configuration permits the tip of the upper handle of item 218 to be received in opening 298 and captured in channel 340, while each seat 338 engages a portion of elongated item 218, thereby neatly maintaining such items equally separated, substantially in the same manner as that achieved with pegboard merchandising. FIGS. 23 and 24 also illustrate that ramp 300 and the configuration of front and rear walls 238, 254 cooperate to advantageously display desirable features of item 218.

It is understood that the above description is of preferred exemplary embodiments of the present invention, and that the invention is not limited to the specific forms described. For example, display shippers in accordance with the present invention may advantageously be shaped and dimensioned to permit the shipment and display of items of configurations other than those described herein. In this vein, it should be noted that while for obvious weight distribution reasons the preferred embodiments disclose a pair of oppositely facing ramps 100 (or 300), those skilled in the art will appreciate that the present invention is not intended to be limited to those configurations which are preferred in display shippers designed to be used with elongated garden tool items. Moreover, even though certain features of the present embodiments have been described with particularity, it should be understood that certain substitutions, modifications, changes, and omissions of these features may be made in the design and arrangement of the elements herein disclosed without departing from the scope of the appended claims.

What is claimed is:

1. A shipping and display carton having a width, depth, and height, for containing a plurality of elongated items each having a tip and a distal end, the carton comprising in combination:

a. a display tray including a bottom, two opposed side walls, a front wall, and a rear wall;

b. at least one ramp removably received widthwise within said display tray, said ramp comprising an upper surface having opposite upper and lower margins and opposite front and rear sides, said margins extending substantially parallel to the side walls of said tray, said upper margin being elevated with respect to said lower margin by a distance that is less than the height of said carton thereby forming an incline plane to support said items thereon;

c. an upper telescoping cover dimensioned to overlie said display tray, said upper cover having a top, oppositely facing side panels, a front panel and a rear panel, said front and rear panels being hingedly connected to said top; and d. a plurality of securing elements releasably maintaining said front panel and said rear panel against said front and rear walls, respectively, thereby preventing inadvertent sliding of said cover during shipment of said carton;

whereby after removal of said securing elements, said cover may slide off said display tray in the direction of the depth of said carton to permit access to said items.

2. The carton of claim 1 wherein said securing elements consist of binding straps.

3. The carton of claim 2 wherein said binding straps are taut around said carton over its height and at least another of its dimensions.

4. The carton of claim 1 wherein said front panel includes at least one opening to facilitate sliding said cover off said display tray.

5. The carton of claim 1 wherein said front and rear walls have cut out sections to permit viewing of, and facilitate access to, the items, said upper surface supporting said items in front of said cut out sections.

6. The carton of claim 1 wherein said ramp further comprises a divider located intermediate said upper and lower margins, said divider projecting from said upper surface by a predetermined distance and extending substantially along the depth of said ramp, said divider having a plurality of receiving seats at spaced positions, each of said seats being adapted to engage one of said items to maintain suitable separation between said items.

7. The carton of claim 1 wherein a pair of oppositely facing ramps are received within said tray.

8. The carton of claim 7 wherein:

a. each of said side walls includes a web and respective inner and outer panels, said web interconnecting said inner and outer panels along respective inner and outer score lines to define a channel in said side wall; and b. each of said upper margins is proximate a corresponding one of said inner score lines when said ramps are received within said tray.

9. The carton of claim 8 further comprising a plurality of openings formed in each of said inner panels at spaced positions inwardly of, and along a line generally parallel to, said inner score line, said openings being formed in regions of said inner panels extending from non-adjacent corners of said carton substantially over a distance corresponding to the depth of said ramp, whereby when said items are disposed on said ramps with the tips proximate said upper margins, said tips are received within one of said channels after passing through one of said openings.

10. The carton of claim 8 further comprising a plurality of elongated openings formed in each of said webs at spaced positions inwardly of, and generally perpendicular to, said outer score line, said openings extending through said inner score line into said inner panel by a predetermined distance, said openings being formed in regions of said webs extending from non-adjacent corners of said carton substantially over a distance corresponding to the depth of said ramp, whereby when said items are disposed on said ramps with the tips proximate said upper margins, the distal ends of said items are substantially received within said channels when disposed in a corresponding one of said openings.

11. The carton of claim 9 wherein:

a. each of said ramps further comprises a divider located intermediate the width thereof, said divider projecting from said upper surface by a predetermined distance and extending substantially along the depth of said ramp, said divider having a plurality of receiving seats at spaced positions, each of said seats being adapted to engage one of said items to maintain suitable separation between said items; and b. each of said openings is substantially in alignment with a respective one of said seats.

12. A display shipper for elongated items, said shipper having a width, depth, and height, and comprising a display tray and at least one ramp removably received within said tray, said ramp having an upper surface and opposite upper and lower margins, said margins extending substantially in the direction of the depth of said carton, said upper margin being elevated with respect to said lower margin by a distance that is less than the height of said carton thereby forming an incline plane to support said items thereon, said display tray being formed from an elongate blank having a plurality of panels hingedly joined by score lines, said blank comprising:

a. a full-width, full-depth, bottom panel for forming the bottom of the tray;

b. first and second full-depth, full-height, outer panels on either side of the bottom panel;

c. first and second full-depth web panels adjoining each of the first and second outer panels, respectively;

d. first and second full-depth, full-height, inner panels at either end of said blank, each of said inner panels adjoining a respective one of said web panels to define a channel when folded oppositely facing a respective one of said outer panels;

e. full-width, full height, front and rear wall panels joined to said bottom panel along the sides of said blank; and f. first and second full height tuck flaps on either end of said front and rear wall panels, said tuck flaps being received within a respective one of said channels when said tray is erected.

13. The display shipper of claim 12 wherein said front and rear wall panels have cut out sections to permit viewing of, and access to, said items.

14. The display shipper of claim 12 wherein said first and second inner panels further include retaining flaps on either end thereof, said retaining flaps engaging said tuck flaps when said tuck flaps are received within a respective one of said channels thereby maintaining said tuck flaps within said channels.

15. The display shipper of claim 12 wherein said first and second inner panels further include retaining elements engaging said bottom panel to maintain each of said inner panels oppositely facing a respective one of said outer panels.

16. The display shipper of claim 12 further comprising:

a. first and second full-depth spacing panels adjoining each of the first and second inner panels, respectively;

b. at least one tab extending from each of said inner panels into the adjoining spacing panel, said tab being formed from a portion cut from said spacing panel; and c. a least one opening formed proximate either end of said bottom panel, inwardly of the score line joining said bottom panel to said outer panel;

whereby when said spacing panel is folded inwardly of said inner panel and said inner panel is folded oppositely facing said outer panel, each of said tabs extends into a corresponding one of said openings.

17. The display shipper of claim 13 wherein said front and rear wall panels also include a plurality of reinforcing flaps hingedly joined to said panels substantially along the margin defining said cut out sections, at least a portion of said reinforcing flaps abutting to said bottom panel when said reinforcing flaps are folded inwardly against said wall panels.

18. The display shipper of claim 12 further comprising a cover, said cover being formed from an elongate blank having a plurality of panels hingedly joined by score lines, said blank forming said cover comprising:

a. a full-width, full-depth, top panel for forming the top of the cover;

b. first and second full-depth, full-height, side panels on either side of the top panel;

c. a full-width, full height, front panel joined to said top panel along one side of said blank forming the cover, said front panel having guiding flaps on either end thereof, said guiding flaps being tucked between said outer panels and said side panels to position said cover over said tray; and d. a full-width, full height, rear panel joined to said top panel along the other side of said blank forming the cover.

19. The display shipper of claim 12 wherein said at least one ramp is formed from an elongate blank having a plurality of hingedly joined panels, said blank forming said ramp comprising:

a. a divider panel having a center score line running perpendicular to the sides of said blank forming the ramp, said divider panel further comprising a plurality of slots generally perpendicular to, and at spaced positions along, said center score line and extending on either side thereof by a predetermined distance;

b. first and second intermediate panels on either end of the divider panel, each of said intermediate panels being joined by a perforated line to said divider panel;

c. upper and lower margin panels joined by a score line to the first and second intermediate panels, respectively; and d. an elevation end flap joined to the upper margin panel by a score line, the height of said end flap being smaller than the full height of said shipper;

whereby when said blank is formed into said ramp, said divider panel forms a divider between said upper margin and lower margin panels, said slots cooperating with said center score line to form seats adapted to engage said items and maintain suitable separation therebetween.

20. The display shipper of claim 19 wherein a pair of half-depth, oppositely facing, ramps are removably received.

21. The display shipper of claim 19 further comprising:

a. first and second truncated triangular-shaped upper margin flaps joined by a score line to said upper margin panel along the sides of said blank forming the ramp;

b. first and second triangular-shaped lower margin flaps joined by a score line to said lower margin panel along the sides of said blank forming the ramp; and c. at least one supporting flap adjoining an intermediate panel along the side of said blank forming the ramp.

22. The display shipper of claim 19 wherein each of said items has a tip and distal end, and wherein said inner panels comprise a plurality of openings formed at spaced positions inwardly of, and along a line generally parallel to, said web panels, said openings being formed in regions of said inner panels extending from nonadjacent corners of said shipper substantially over a distance corresponding to the depth of said ramp;

whereby when said items are disposed on said ramps with the tips proximate said upper margins, said tips are received within one of said channels after passing through one of said openings.

23. A shipping and display carton having a width, depth, and height, for containing a plurality of elongated items each having a tip and a distal end, the carton comprising in combination:

a. a display tray including a bottom, two opposed side walls, a front wall, and a rear wall, said front and rear walls having cut out sections;

b. at least one supporting surface removably received within said display tray, said supporting surface having a plurality of receiving seats at spaced positions, each of said seats being adapted to engage one of said items to maintain suitable separation between said items and hold said items in front of said cut out sections;

c. an upper cover dimensioned to overlie said display tray, said upper cover having a top, oppositely facing side panels, a front panel and a rear panel, said front and rear panels being hingedly connected to said top and overlying said cut out sections; and d. a plurality of securing elements releasably maintaining said front panel and said rear panel against said front and rear walls, respectively, thereby preventing inadvertent sliding of said cover during shipment of said carton;

whereby after removal of said securing elements, said cover may slide off said display tray in the direction of the depth of said carton to permit viewing of, and access to, said items.

24. The carton of claim 23 wherein said front panel includes at least one opening to facilitate sliding said cover off said display tray.

* * * * *